United States Patent [19]

Ajiro et al.

[11] Patent Number: 4,519,788

[45] Date of Patent: May 28, 1985

[54] TOY HAVING TWO BODIES CAPABLE OF CONNECTING TO A THIRD BODY

[75] Inventors: Yutaka Ajiro; Michihiro Kozuka, both of Tokyo, Japan

[73] Assignee: Tomy Kogyo Company, Incorporated, Japan

[21] Appl. No.: 516,552

[22] Filed: Jul. 25, 1983

[51] Int. Cl.[3] ..... A63H 3/22; A63H 3/16

[52] U.S. Cl. ..... 446/356; 446/99

[58] Field of Search ..... 46/17, 22, 123, 149, 46/150, 266; 446/85, 97, 99, 100, 101, 330, 352, 353, 354, 355, 356, 316, 317

[56] References Cited

U.S. PATENT DOCUMENTS

| | | | |
|---|---|---|---|
| 1,724,094 | 8/1929 | Kuen | 46/150 |
| 2,761,243 | 9/1956 | Baggott | 46/149 |
| 2,823,490 | 3/1958 | Griem | 46/22 |
| 3,407,530 | 10/1968 | Grant et al. | 46/22 |
| 3,465,473 | 9/1969 | Nakamura | 46/150 |
| 3,883,983 | 5/1975 | Coster | 46/17 |
| 4,245,515 | 1/1981 | Iwaya | 46/150 |

FOREIGN PATENT DOCUMENTS

| | | | |
|---|---|---|---|
| 549077 | 11/1957 | Canada | 46/149 |

*Primary Examiner*—Robert A. Hafer
*Assistant Examiner*—Daniel Nolan
*Attorney, Agent, or Firm*—K. H. Boswell; Edward D. O'Brian

[57] ABSTRACT

A toy has a front body and a rear body which are connectable directly to each other, or connectable to each other utilizing a third body, such as a pencil or the like. Both the front and the rear bodies include appendage members which contact a support surface and allow the unified front and rear bodies or combination of the front and rear bodies and the third body to move across a support surface in a walking-like motion by individual movement of the appendage members. The appendage members on the front body are driven by a motor located in the front body to move the toy across the support surface, whereas the appendages on the rear body are moved in response to movement of the rear body by the front body.

11 Claims, 7 Drawing Figures

TOY HAVING TWO BODIES CAPABLE OF CONNECTING TO A THIRD BODY

BACKGROUND OF THE INVENTION

This invention is directed to a toy wherein a first and second body are capable of being connected to a third body and when so connected the totality of the bodies are capable of being moved by a motor means located in the first body. Further, the motor means is connected to movable appendages located in said first body with the totality of the bodies being moved by alternate contact of the lower ends of the front appendage with a support surface.

Certain toys are known wherein the toys are capable of exhibiting a rocking motion by alternately moving one appendage with respect to a second. If only two appendages are utilized for the toy, the base of these two appendages must be of a sufficiently broad and planar nature so as to allow each of the bases to individually support the toy. If three or four appendages are utilized to support the toy, it is not necessary to have the bases of planar nature; however it is necessary to coordinate the movement of these appendages in order to have the toy move across a support surface.

In toys which utilize four appendages to support the toy and which generally are shaped so as to mimic animal figures and the like, it is necessary to coordinate the movement of all of the four appendages such that they move simultaneously under the influence of a motor or the like. As such, it is necessary for the bodies of these toys to be a unified member, with appropriate connecting links between the front and rear appendages and the motor such that all the appendages can be made to move in unison.

Heretofore, it has been impossible to construct toys which are capable of moving in a walking-like motion with a portion of the toy incorporating moveable appendages which are driven by a motor and a second portion of the toy separable from the first portion but also including appropriate appendages which are capable of moving in a walking motion. While heretofore it has been possible to construct toys with the separable appendage which could be moved by a rolling motion or the like, as stated in the previous sentence, a walking motion has not been achieved.

BRIEF DESCRIPTION OF THE INVENTION

In view of the above, it is a broad object of this invention to construct a toy which has first and second body sections which are connectable to one another or disconnectable from one another and connectable to a third member connecting the two together with both body sections capable of being moved across a support surface in a walking-like motion. It is a further object of this invention to provide a toy which can incorporate a common implement such as a pencil or the like as a portion of the toy in order to lend a unique appearance to the toy. It is a further object of this invention to provide such a toy, which, because of its engineering and manufacturing principles is extremely reliable in use and is economical in manufacture and thus widely available to the consuming public.

These and other objects, as will become evident from the remainder of this specification are achieved in a toy which comprises: a front body, said front body including connecting means connecting said front body to another body; said front body further including motor means located in said front body; a left and right front appendage member each pivotally mounted in said front body, each of said front appendage members being essentially vertically oriented and including a lower end, said lower ends of said front appendage members forming surface contact points for said front body whereby said front body is supported on a support surface by said front appendage members' lower ends contacting said surface; said motor means operatively associated with each of said front appendage members to alternately move said front appendage member, said lower ends of said front appendage members moving in a circuit in response to movement of said front appendage members, the lower end of one of said front appendage members moving through said circuit one hundred and eighty degrees out of phase with respect to the movement of the lower end of the other of said front appendage members through said circuit, said circuit of movement of each of said lower ends of said front appendage members comprising said lower ends of said front appendage members moving forward, then downward, then backward and then upward to complete said circuit with the lower ends of said front appendage members contacting said surface as they respectively move backwardly; a rear body, said rear body including connecting means for connecting said rear body to another body; a left and right rear appendage member, each of said rear appendage members independently pivotally mounted to said rear body, each of said rear appendage members being essentially vertically oriented and including a lower end, the lower ends of said rear appendage members forming surface contact points for said rear body whereby said rear body is supported on said surface by said rear appendage members' lower ends contacting said surface; each of said lower ends of said rear appendage member of a sufficient weight such that in the absence of any outside forces said rear appendage members' lower ends are biased downwardly by gravity to essentially vertically orient said rear appendage members, each of said rear appendage members' lower ends independently displaceable rearwardly if said lower ends of said rear appendage members are engaged against said surface and simultaneously said rear body is moved forward; said front and rear bodies directly connectable to each other by said respective connecting means on said front and rear bodies and indirectly connectable to each other by connecting said respective connecting means on said front and rear bodies to a third body and when so connected to each other said front and rear bodies being moved forward in unison as each of said lower ends of said front appendage members moves rearwardly after said contact with said support surface and further when so connected to each other said front and said rear bodies rocking side to side in unison as said lower ends of said lower appendage members alternately contact said surface; said lower ends of said rear appendage members alternately being moved rearwardly as said rear body is moved forward by said front body and after being so moved rearwardly, then forwardly under the bias of gravity as said front and rear bodies rock side to side.

Preferrably, the motor means would include a crank with a first and second crank arm located on the crank with the crank arms located one hundred eighty degrees with respect to one another. The front appendages would be connected to the respective crank arms such that, upon rotation of the crank, the front appendages would be moved with the lower ends of the front appendages moving one hundred eighty degrees out of phase with one another as a result of the crank arms being located one hundred eighty degrees out of phase with one another.

Preferredly, the third body would comprise an elongated body which is connectable to both the front and rear bodies. As an appropriate example of this elongated body would be a pencil or the like.

When so used with an elongated body, the connecting means in the rear body would be sized and shaped so as to allow the pencil or other elongated body to pass through the rear body and project outwardly from the rear body on both sides of the opening.

BRIEF DESCRIPTION OF THE DRAWINGS

This invention will be better understood when taken in conjunction with the drawings wherein.

Figure 1:
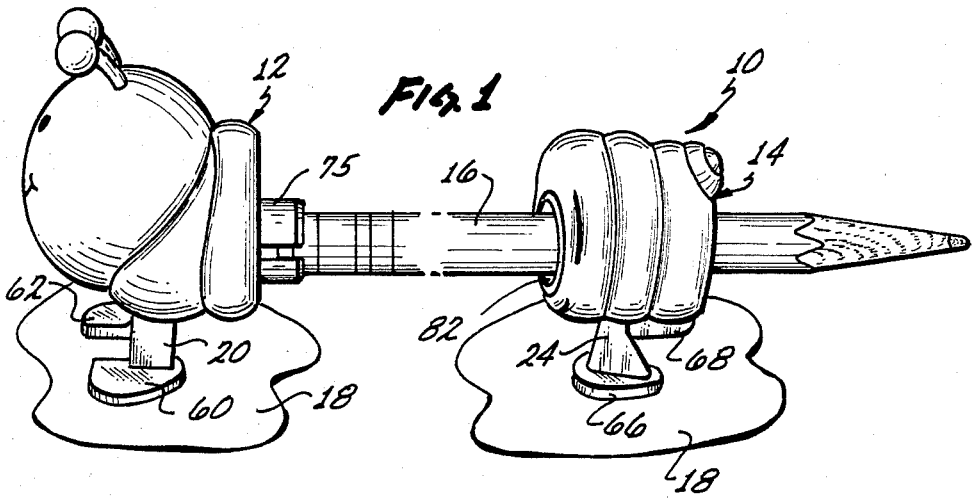
FIG. 1 is an oblique view of an embodiment of the invention which utilizes a pencil as a connecting member between a first and second component of the invention.

The invention described in this specification and shown in the drawings utilizes certain principles and/or concepts as are set forth in the claims appended to this specification. Those skilled in the toy arts will realize that these principles and/or concepts are capable of being illustrated in a variety of embodiments differing from the exact illustrative embodiment illustrated herein. For this reason this invention is not to be construed as being limited to the exact illustrative embodiment but is to be construed as being limited only in light of the claims.

DETAILED DESCRIPTION OF THE INVENTION

In the Figures, there is shown a toy 10 of the invention. As seen in FIG. 1, the toy has a front body 12 and a rear body 14 which are not fixedly connected to one another but are connectable to one another via two mechanisms.

Figure 2:
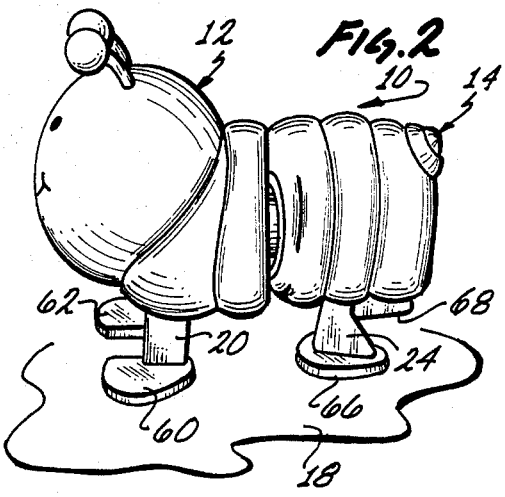
FIG. 2 is similar to FIG. 1 except the use of the pencil to connect the two components is not shown and the two components are directly linked to one another.

As seen in FIG. 1, the front body 12 and the rear body 14 are indirectly connected by a third body, a pencil 16. In FIG. 2 the front and rear bodies 12 and 14, respectively, are directly connected together. Irrespective of whether the front or rear bodies 12 and 14 are connected directly to one another as in FIG. 2, or indirectly to one another as per a third body, the pencil 16 of FIG. 1, the toy 10 is capable of moving across a support surface 18 in a walking-like motion.

The front body 12 includes a left front leg 20 and right front leg 22. The rear body 14 includes a left rear leg 24 and right rear leg 26. The legs 20, 22, 24 and 26 constitute the only portions of the toy 10 which contact the support surface 18. All of the legs 20, 22, 24 and 26 are articulated to either body 12 or body 14 and moved with respect to the bodies 12 and 14 so as to propel the toy 10 across the support surface 18. A small spring motor 28 of a standard design is located in the front body 12. The motor 28 includes a shaft 30 having a knurled knob 32 on the end thereof which projects out of the right side of the front body 12. The knurled knob 32 allows for energizing the motor 28 by rotation of the same by a child utilizing the toy 10. The motor 28 is fixedly held within the front body 12 by being appropriately encased within webs collectively identified by the numeral 34 formed within the front body 12.

Figure 3:
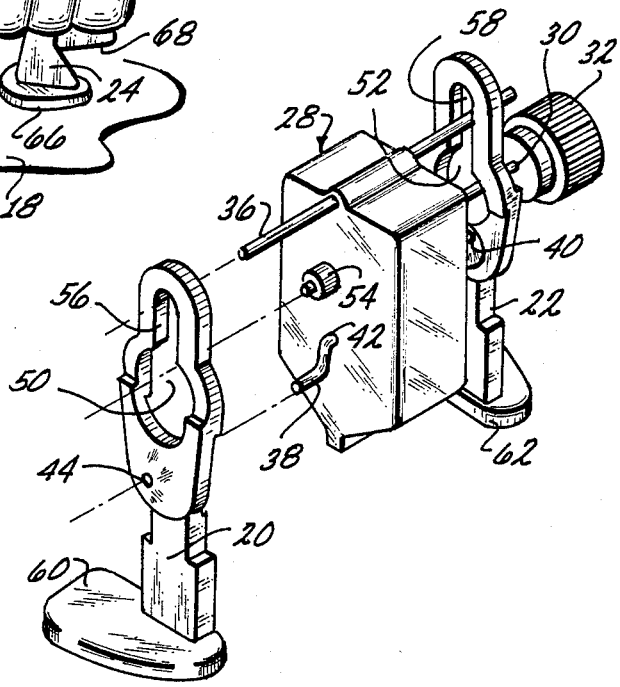
FIG. 3 is an isometric view showing a motor mechanism located in the leftmost components of FIGS. 1 and 2.

The motor 28 has a shaft 36 which projects out of its right and left sides near its top. The shaft 36 is stationary and serves only as a guide, as hereinafter explained. Additionally, projecting out of the left and right sides of the motor 28 are crank arms 38 and 40, respectively. The crank arms 38 and 40 are formed as a part of a crank 42 which is rotated by the motor 28 in response to the motor 28 being energized by winding the knurled knobs 32. As seen in FIG. 3, the crank arm 38 is rotated counterclockwise by the motor 28. Additionally, crank arm 40, since it is a part of the same crank 42, would also be rotated counterclockwise in the orientation seen in FIG. 3, even though crank arm 40 is not shown in FIG. 3.

Figure 6:
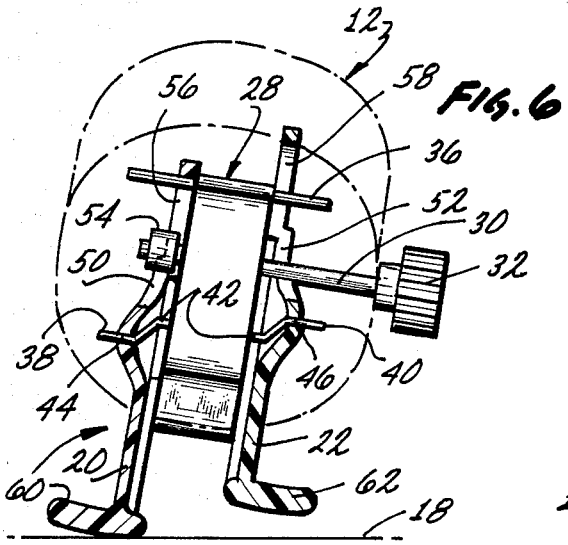
FIG. 6 is an end elevational view in partial section about the line 6—6 of FIG. 5.

The individual crank arms 38 and 40 of the crank 42 are located one hundred and eighty degrees out of phase with respect to one another. That is, the crank arm 38 as seen in FIG. 6 is projecting downwardly, while the crank arm 40 as seen in FIG. 6 is projecting upwardly. Rotation of the crank 42 thus results in rotation of the crank arms 38 and 40 one hundred and eighty degrees out of phase at all times.

The left front leg 20 includes an opening 44 located therein which allows for positioning of the left leg 20 over the left crank arm 38. Likewise, the right front leg 22 includes an opening 46 which allows positioning of the right front leg 22 over the right crank arm 40. The left front leg 20 further includes a keyhole shaped opening 50 which serves two functions. Likewise the right leg 22 includes a keyhole shaped opening 52. The large portion of the keyhole opening 50 fits around the end of a bushing 54 formed on the end of the shaft 30 opposite where the knurled knob 32 is located. The bushing 54 holds the shaft 30 to the motor 28. The keyhole shaped opening 50 is sized such that at all times the left front leg 20 can move about the bushing 54 without contacting the same. Additionally, the keyhole shaped opening 50 includes an upper, vertically oriented channel 56 which fits over the left hand side of the shaft 36. In the same manner, the keyhole shaped opening in the right front leg 22 fits around the end of the shaft 30 wherein knurled knob 32 is located with its corresponding channel 58 fitting over the right hand side of the shaft 36.

As the crank 42 rotates, the crank arm 38, by being located in the opening 44 in the left front leg 20, transfers its rotational movement to the left front leg 20. Because the channel 56 of the keyhole shaped opening 50 is vertically oriented, the top portion of the left front leg 20 can only move up and down about the shaft 36. Since the crank arm 38 is rotating in the opening 44, this causes the bottom end 60 (which is shaped as a foot) of the left front leg to move through a circuit in a circular motion. In response to rotation of the crank arm 38, the end 60 (starting in the orientation as seen in FIG. 3) first moves backwardly, then upwardly, then forwardly, and then downwardly to the original position. Thus, the bottom end 60 of the left front leg 20 moves in a closed circuit in response to rotation of the crank 42.

Likewise, the right front leg 22 has a bottom end 62 which is also shaped as a foot-like member and it, too, moves in a circuit analogous to the circuit described in the previous paragraph. The bottom end 62 of the right front leg 22 however, moves one hundred and eighty degrees out of phase with respect to the bottom end 60 of the left front leg 20. Thus, while the end 60 of the left front leg 20 is moving backwardly in the down position, the end 62 of the right front leg 22 is moving forwardly in the up position. This causes the left and right front legs 20 and 22 to move in a walking-like motion.

As seen in FIG. 6 wherein the left front leg 20 is in the downward position and the right front leg 22 is in the upward position, the front body 12 is allowed to pivot toward the side wherein the appropriate respective leg 20 or 22 is raised. When the right front leg 22 contacts the surface 18, the front body 12 will pivot in the opposite direction as that seen in FIG. 6. The left and right front legs 20 and 22 then serve two purposes. One, they can propel the front body 12 forwardly as their respective bottom ends 60 and 62 contact the support surface 18 and move backwardly, and, two, they cause the front body 12 to rock from side to side as first one and then the other is lifted upwardly from the support surface 18, and then alternately descends downwardly toward the support surface 18.

Figure 4:
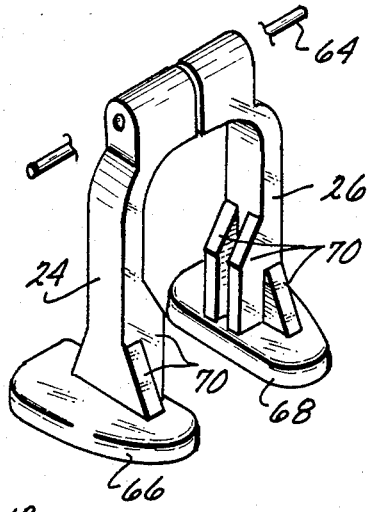
FIG. 4 is an isometric view showing mechanisms located in the rightmost component of FIGS. 1 and 2.

The rear body 14 has an axle 64 located therein. Suspended from the axle 64 are the left rear leg 24 and the right rear leg 26. Both the left rear leg 24 and the right rear leg 26 have most of their mass concentrated toward their respective bottom ends 66 and 68, respectively. This is achieved by the foot-like pedestals which are evident in FIG. 4, as well as the location of webs collectively identified by the numeral 70 near the bottom ends 66 and 68. Because of the distribution of mass of the left and right rear legs 24 and 26 toward the respective ends 66 and 68, they tend to want to hang straight vertically downwardly from the axle 64.

Figure 5:
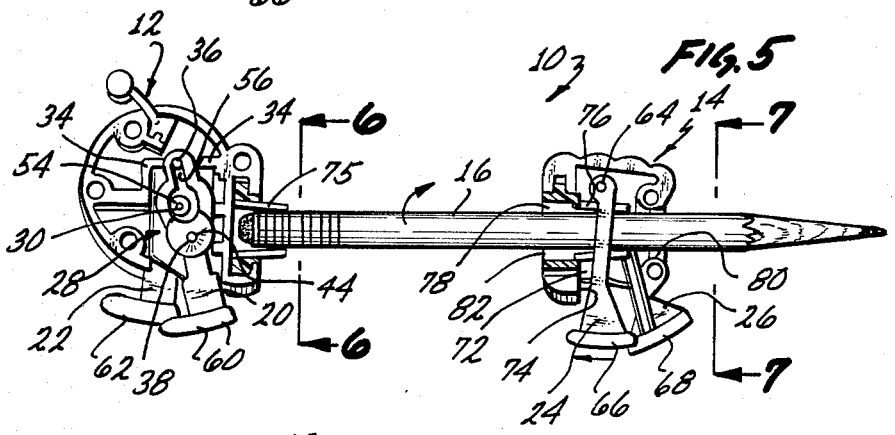
FIG. 5 is a side elevational view in section of FIG. 1.

The rear body 14 includes an opening 72 on its underneath side which has a front edge 74 which is positioned such that both the left and right rear legs 24 and 26 can hang straight vertically downwardly from the axle 64, but cannot be pushed forwardly as seen in FIG. 5 with respect to a vertical line which would pass through the axle 64. The opening 72, however, is sufficiently elongated toward the back of the rear body 14 such that the left and right rear legs 24 and 26 can be swung out of their vertical alignment toward the back of the rear body 14.

The front body 12 includes a slotted cylindrical boss 75 extending rearwardly. The boss 75 is sized and shaped so as to accept the eraser end of a pencil 16, or other elongated body of approximately the same dimensions as a pencil. The slots in the boss 75 allow for the boss 75 to be slightly undersized and to be expanded slightly to receive the eraser end of a pencil 16 so as to fixedly hold the blunt, or eraser end of a pencil 16 to the front body 12.

The rear body 14 includes a slotted cylinder 76 located within the rear body 14. The rear body 14 has a front opening 78 and a rear opening 80 with a continuous passageway from the front opening 78 through the cylinder 76 to the rear opening 80. The cylinder 76 is slotted and is slightly undersized with respect to the diameter of a common pencil 16. This allows for the pencil 16 to be passed through the front opening 78 through the cylinder 76 and gripped by the cylinder 76 with a portion of the pencil 16 able to be extended outwardly through the rear opening 80 and to extend beyond the back side of the rear body 14.

The front and rear bodies 12 and 14 are thus connectable to one another via a third body such as a pencil 16 as seen in FIGS. 1 and 5. Additionally, the cylinder 76 is slightly expanded at its front end 82 so as to accept the boss 75 to directly connect the front and rear bodies 12 and 14 together as seen in FIG. 2. It is thus evident that the front and rear bodies 12 and 14 can be connected directly to one another or can be indirectly connected via a third body such as a pencil 16.

The toy 10 moves across a support surface 18 in the following manner, irrespective of whether or not the front and rear bodies 12 and 14 are directly connected to one another or indirectly connected to one another via a pencil 16 or the like. As the front legs 20 and 22 are alternately moved upwardly, forwardly, downwardly and backwardly, their respective ends 60 and 62 contact the support surface 18. When one of the respective ends 60 or 62 contact the support surface 18 as the ends 60 or 62 move backwardly with respect to movement of these ends through the circuits described above, contact of the ends 60 or 62 on the support surface 18 propels the front body 12 forward. Meanwhile, the ends 66 and 68 of the respective rear legs 24 and 26 can rest on the support surface 18.

Figure 7:
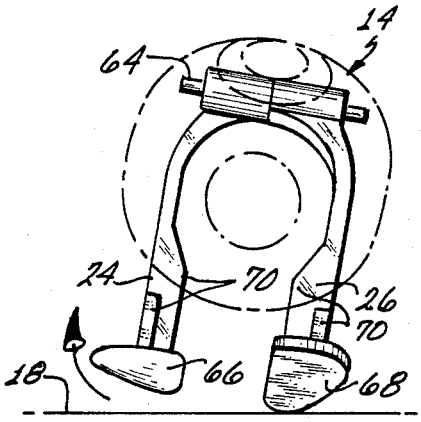
FIG. 7 is an end elevational view about the line 7—7 of FIG. 5.

When the rear body 14 is moved fowardly by being dragged along by the front body 12, its respective legs 22 and 24 can be pivoted backwardly about the axle 64. As noted above, however, as the front legs 20 and 22 are moved, the front body 12 is also rocked from side to side. When the front body 12 is rocked to one side or the other, this rocking motion is transferred directly to the rear body 14 or indirectly through the pencil 16 to the rear body 14. This allows only one or the other of the ends 66 or 68 of the rear legs 24 or 26 to contact the support surface 18. One of the ends, be it end 66 or end 68 is lifted upwardly from the support surface 18 in response to the rocking motion of the rear body 14. This is evident as seen in FIG. 7. The particular end (as seen in FIG. 7, end 66,) being lifted above the support surface is then moved forwardly by gravity such that it assumes a direct vertical alignment underneath the axle 64. The other end, (end 68 as seen in FIG. 7) because it is in contact with the support surface 18 is moved backwardly, pivoting the respective leg about the axle 64.

When the totality of the toy 10 rocks to the opposite direction (to the left as opposed to the right as seen in FIG. 6) the rear leg, be it leg 24 or 26, which had been moved backwardly because of contact of its end, be it end 66 or 68, with the support surface 18, is now allowed to pivot forwardly under the influence of gravity, with the opposite leg being dragged backwardly because of contact between its respective end and the support surface 18.

As is evident from the above discussion, the rear legs 24 and 26 are alternately moved backwardly by contact of the respective ends 66 or 68 with the support surface 18 and then allowed to swing forwardly under the influence of gravity when they are lifted upwardly from the support surface 18 because of the rocking motion of the front body 12. The toy 10 thus progresses across a support surface by being propelled across the support surface by the movement of the front legs 20 and 22 under the influence of the rotation outputted by the motor 28. The toy 10 is maintained in balance by the pedestal support provided by the rear legs 24 and 26 with the rear legs 24 and 26 alternately being first moved backwardly under friction between their respective ends and the support surface 18 and then forwardly under the influence of gravity when the respective leg is lifted upwardly from the support surface 18.

I claim:

1. A toy which comprises:

a front body, said front body including connecting means for connecting said front body to another body;

said front body further including motor means located in said front body;

a left and right front appendage member each pivotally mounted on said front body, each of said front appendage members being essentially vertically oriented and including a lower end, said lower ends of said front appendage members forming surface contact points for said front body whereby said front body is supported on a support surface by said front appendage members' lower ends contacting said surface;

said motor means operatively associated with each of said front appendage members to alternately move said front appendage members, said lower ends of said front appendage members moving in a circuit in response to movement of said front appendage members, the lower end of one of said front appendage members moving through said circuit one hundred and eighty degrees out of phase with respect to the movement of the lower end of the other of said front appendage members through said circuit, said circuit of movement of each of said lower ends of said front appendage members comprising said lower ends of said front appendage members moving forward, then downward, then backward and then upward to complete said circuit with the lower ends of said front appendage members contacting said surface as they respectively move backwardly;

a rear body, said rear body including connecting means for connecting said rear body to another body;

a left and right rear appendage member, each of said rear appendage members independently pivotally mounted to said rear body, each of said rear appendage members being essentially vertically oriented and including a lower end, the lower ends of said rear appendage members forming surface contact points for said rear body whereby said rear body is supported on said surface by said rear appendage members' lower ends contacting said surface;

each of said lower ends of said rear appendage members of a sufficient weight such that in the absence of any outside forces said rear appendage members' lower ends are biased downwardly by gravity to essentially vertically orient said rear appendage members, each of said rear appendage members' lower ends independently displaceable rearwardly if said lower ends of said rear appendage members are engaged against said surface and simultaneously said rear body is moved forward;

said front and rear bodies directly connectable to each other by said respective connecting means on said front and rear bodies and indirectly connectable to each other by connecting said respective connecting means on said front and rear bodies to a third body and when so connected to each other said front and rear bodies being moved forward in unison as each of said lower ends of said front appendage members moves rearwardly after said contact with said support surface and further when so connected to each other said front and said rear bodies rocking side to side in unison as said lower ends of said lower appendage members alternately contact said surface;

said lower ends of said rear appendage members alternately being moved rearwardly as said rear body is moved forward by said front body and after being so moved rearwardly, then forwardly under the bias of gravity as said front and rear bodies rock side to side.

2. The toy of claim 1 wherein:

said third body comprises an elongated body and said connecting means on said front and rear bodies are sized and shaped to connect to said elongated body.

3. The toy of claim 2 wherein:

said elongated body is a pencil.

4. The toy of claim 3 wherein:

said connecting means on said rear body includes said rear body having a horizontal opening, said opening sized and shaped to allow said pencil to pass through said opening.

5. The toy of claim 4 wherein:

said motor means includes a crank, said crank having first and second crank arms formed as a part thereof, said crank arms spaced apart from one another in a position one hundred and eighty degrees from each other about said crank, said motor capable of being energized and upon being energized rotating said crank to rotate said crank arms with said crank arms rotating one hundred and eighty degrees out of phase with respect to one another;

each of said right and said left front appendage members pivotally mounted to one of said crank arms, each of said front appendage members moving in response to rotation of said crank so as to move said lower ends of said front appendage members through said circuits.

6. The toy of claim 1 wherein:

said motor means includes a crank, said crank having first and second crank arms formed as a part thereof, said crank arms spaced apart from one another in a position one hundred and eighty degrees from each other about said crank, said motor capable of being energized and upon being energized rotating said crank to rotate said crank arms with said crank arms rotating one hundred and eighty degrees out of phase with respect to one another;

each of said right and said left front appendage members pivotally mounted to one of said crank arms, each of said front appendage members moving in response to rotation of said crank so as to move said lower ends of said front appendage members through said circuits.

7. The toy of claim 6 wherein:

said elongated body is a pencil.

8. The toy of claim 7 wherein:

said connecting means on said rear body includes said rear body having a horizontal opening, said opening sized and shaped to allow said pencil to pass through said opening.

9. The toy of claim 1 wherein:

said connecting means on said front body includes;

a cylindrical member;

said connecting means on said rear body includes a cylindrical opening and a cylindrical member, said cylindrical member on said front bodies sized and shaped so as to fit within said cylindrical opening on said rear body so as to connect said rear body to said front body and said cylindrical member on said front body and said cylindrical member on rear body sized and shaped so as to fit around a pencil and grip said pencil so as to connect said front and said rear body to said pencil.

10. In combination with a pencil a toy which comprises:

a front body, said front body including connecting means for connecting said front body to another body;

said front body further including motor means located in said front body;

a left and right front appendage member each pivotally mounted on said front body, each of said front appendage members being essentially vertically oriented and including a lower end, said lower ends of said front appendage members forming surface contact points for said front body whereby said front body is supported on a support surface by said front appendage members' lower ends contacting said surface;

said motor means operatively associated with each of said front appendage members to alternately move said front appendage members, said lower ends of said front appendage members moving in a circuit in response to movement of said front appendage members, the lower end of one of said front appendage members moving through said circuit 180° out of phase with respect to the movement of the lower end of the other of said front appendage members through said circuit, said circuit of movement of each of said lower ends of said front appendage members comprising said lower ends of said front appendage members moving forward, then downward, then backward and then upward to complete said circuit with the lower ends of said front appendage members contacting said surface as they respectively move backwardly;

a rear body, said rear body including connecting means for connecting said rear body to another body;

a left and right rear appendage member, each of said rear appendage members independently pivotally mounted to said rear body, each of said rear appendage members being essentially vertically oriented and including a lower end, the lower ends of said rear appendage members forming surface contact points for said rear body whereby said rear body is supported on said surface by said rear appendage members' lower ends contacting said surface;

each of said lower ends of said rear appendage members of a sufficient weight such that in the absence of any outside forces said rear appendage members' lower ends are biased downwardly by gravity to essentially vertically orient said rear appendage members, each of said rear appendage members' lowe ends independently displaceable rearwardly if said lower ends of said rear appendage members are engaged against said surface and simultaneously said rear body is moved forward;

said front and rear bodies directly connectable to each other by said respective connecting means on said front and rear bodies and indirectly connectable to each other by connecting said respective connecting means on said front and said rear bodies to said pencil and when so connected to each other said front and rear bodies being moved forward in unison as each of said lower ends of said front appendage members moves rearwardly after said contact with said support surface and further when so connected to each other said front and said rear bodies rocking side to side in unison as said lower ends of said lower appendage members alternately contact said surface;

said lower ends of said rear appendage members alternately being moved rearwardly as said rear body is moved forward by said front body and after being so moved rearwardly, then forwardly under the bias of gravity as said front and rear bodies rock side to side.

11. The toy of claim 10 wherein:

said connecting means on said front body includes;

a cylindrical member;

said connecting means on said rear body includes a cylindrical opening and a cylindrical member, said cylindrical member on said front bodies sized and shaped so as to fit within said cylindrical opening on said rear body so as to connect said rear body to said front body and said cylindrical member on said front body and said cylindrical member on rear body sized and shaped so as to fit around a pencil and grip said pencil so as to connect said front and said rear body to said pencil.

* * * * *